United States Patent [19]

Didchenko et al.

[11] Patent Number: 4,645,584

[45] Date of Patent: Feb. 24, 1987

[54] MESOPHASE PITCH FEEDSTOCK FROM HYDROTREATED DECANT OILS

[75] Inventors: Rostislav Didchenko, Middleburg Heights; Irwin C. Lewis, Strongsville, both of Ohio

[73] Assignee: Amoco Corporation, Chicago, Ill.

[21] Appl. No.: 756,929

[22] Filed: Jul. 19, 1985

Related U.S. Application Data

[63] Continuation of Ser. No. 688,289, Jan. 7, 1985, which is a continuation of Ser. No. 637,684, Aug. 3, 1984, which is a continuation of Ser. No. 535,613, Sep. 26, 1983, which is a continuation of Ser. No. 487,591, Apr. 25, 1983, which is a continuation of Ser. No. 305,195, Sep. 24, 1981.

[51] Int. Cl.[4] ..... C10G 45/00; C10G 45/72; C01C 1/00; C01C 3/00

[52] U.S. Cl. ..... 208/40; 208/143; 208/144

[58] Field of Search ..... 208/40, 143, 144

[56] References Cited

U.S. PATENT DOCUMENTS

| | | | |
|---|---|---|---|
| 4,391,788 | 7/1983 | Uemura et al. | 208/40 |
| 4,397,830 | 8/1983 | Uemura et al. | 208/40 |
| 4,460,455 | 7/1984 | Moriya et al. | 208/40 |
| 4,462,894 | 7/1984 | Moriya et al. | 208/40 |
| 4,469,907 | 9/1984 | Araki et al. | 208/143 |

*Primary Examiner*—Andrew H. Metz
*Assistant Examiner*—Helane Myers
*Attorney, Agent, or Firm*—George A. Skoler; William T. McClain; William H. Magidson

[57] ABSTRACT

A feedstock for mesophase pitch is produced by hydrotreating a decant oil until there is from about 2 to about 3 hydrogen atoms per average molecule of the decant oil, and thereafter subjecting the hydrotreated decant oil to distilling to form a pitch.

4 Claims, 2 Drawing Figures

MESOPHASE PITCH FEEDSTOCK FROM HYDROTREATED DECANT OILS

This application is a continuation of prior U.S. application Ser. No. 688,289, filed Jan. 7, 1985, which is a continuation of application Ser. No. 637,684, filed Aug. 3, 1984, which is a continuation of application Ser No. 535,613, filed Sept. 26, 1983, which is a continuation of application Ser. No. 487,591, filed Apr. 25, 1983, which is a continuation of application Ser. No. 305,195, filed Sept. 24, 1981.

The invention relates to mesophase pitch and particularly to a feedstock for mesophase pitch.

Mesophase pitch is used for producing carbon artifacts and particularly for producing carbon fibers having excellent mechanical properties. It is well known that mesophase pitch derived carbon fibers are lightweight, strong, stiff, electrically conductive, and both chemically and thermally inert. The mesophase pitch derived carbon fibers perform well in composites and have found use in aerospace applications and quality sporting equipment.

As used herein, the term "mesophase" is to be understood as used in the instant art and generally is synonymous with liquid crystal. A liquid crystal is a state of matter which is intermediate between crystalline solid and a normal liquid. Ordinarily, a material in the mesophase state exhibits both anisotropic and liquid properties.

As used herein, the term "mesophase pitch" is a pitch containing more than about 40% by weight mesophase and is capable of forming a continuous anisotropic phase when dispersed by agitation or the like, in accordance with the prior art.

Generally, decant oil is converted to a pitch by distillation. Sometimes the distillation is preceded by a heat treatment step. The product obtained from the distillation is an isotropic pitch and this pitch must be subjected to additional process steps to convert it to a mesophase pitch.

A conventional method for preparing mesophase pitch from an isotropic pitch feedstock generally includes heat treating the feedstock at a temperature from about 350° C. to 450° C. to effect thermal polymerization.

A typical conventional method is carried out using reactors maintained at a temperature of about 400° C. for about 20 hours. The properties of the mesophase pitch produced can be controlled by the reaction temperature, heat treatment time, and volatilization rate. The presence of the high molecular weight fraction due to polymerization results in a softening point of the mesophase pitch of at least about 300° C. for a mesophase content of about 80% by weight. The softening point increases as the mesophase content increases. Typically, the temperature needed to spin the mesophase pitch into fibers is about 30° C. to about 50° C. higher than the softening point of the mesophase pitch. It is desirable to be able to spin at relatively low temperatures to avoid additional polymerization which can clog the narrow orifices used in spinning and to minimize the energy consumption.

The mesophase content of pitch can be measured by methods described in the article "Quantitative Determination of Mesophase Content in Pitch" by S. Chwastiak, R. T. Lewis, and J. D. Ruggiero, Fifteenth Biennial Conference on Carbon, June 1981, pp. 148, 149.

Generally, the terms "softening point" and "melting point" are used interchangeably in the art to characterize a pitch broadly as to its molecular weight composition and to provide an estimate of the spinning temperature needed.

There are several methods for determining the softening temperature and the temperatures measured by these different methods vary somewhat from each other.

The Mettler softening point measurement procedure is widely accepted as the standard for evaluating pitches. This procedure can be adapted for use on mesophase pitches.

The softening temperature of a mesophase pitch can also be determined by hot stage microscopy. In this method, the mesophase pitch is heated on a microscope hot stage in an inert atmosphere under polarized light. The temperature of the mesophase pitch is raised under a controlled rate and the temperature at which the mesophase pitch commences to deform is noted as the softening temperature.

As used herein, softening point or softening temperature will be used interchangeably and will refer to the temperature determined by the Mettler measurement procedure for both precursor and mesophase pitches.

As used herein, the empirical formulas of the decant oils prior and after the hydrotreatment were obtained from molecular weight and elemental analysis data in accordance with conventional methods.

Decant oils are widely used for producing feedstocks in the form of isotropic pitches to be converted into mesophase pitches. The methods for producing a precursor pitch from a decant oil are well known and usually include the the step of distilling the decant oil under a reduced pressure while applying heat to the decant oil.

Decant oils are particularly desirable for producing precursor pitches for mesophase pitches because decant oils have high aromaticity and the art teaches that high aromaticity in the feedstock is necessary to produce a good mesophase pitch. See "Chemistry and Physics of Carbon", edited by P. L. Walker, Volume 4, pp. 261, 262 (1960); "Carbon". 12, p. 332, (1974); and U.S. Pat. No. 4,005,183 to Singer.

The decant oil used in the art for making a feedstock for mesophase pitch has a low sulfur content in the range of from about 1% to about 2.5% by weight. The mesophase pitch produced from the feedstock is capable of forming anisotropic domains greater than about 200 microns under quiescent heating. The capability of forming such large domains is important because it indicates that the mesophase pitch is suitable for producing carbon fibers having good mechanical properties, as well as good spinning properties.

A mesophase pitch which is capable of forming large anisotropic domains is known to be highly deformable.

For spinning commercially, the mesophase content of the mesophase pitch is at least 70% by weight and preferably about 80% in order to produce good carbon fibers. This is a goal of the instant invention.

The amount of sulfur in a decant oil could be important for the production of commercial carbon fibers. Carbon fibers which require process temperatures of about 2500° C. or higher may have problems because the elevated temperatures drive off the sulfur and thereby result in a degradation in tensile strength and a reduction in the density of the carbon fiber produced.

According to the prior art, a high sulfur decant oil would be unsuitable for the production of a mesophase pitch for quality carbon fibers.

It would be desirable to subject the high sulfur decant oil to a hydrodesulfurization in accordance with known processes such as taught in U.S. Pat. No. 4,075,084 to Skripek et al or U.S. Pat. No. 4,166,026 to Fukui et al. Generally, the hydrodesulfurization contacts a hydrocarbon oil with hydrogen in the presence of a catalyst.

It is, however, well known that hydrotreating reduces the aromaticity of hydrocarbon oils so that it would be expected from the art that a hydrogreated decant oil would produce a mesophase pitch which has relatively poor quality for spinning and the carbon fibers made from the mesophase pitch would have poor mechanical properties. The references, "Catalysis", Vol. V, edited by P. H. Emmett, published by Rheinhold Publishing Corp., New York, 1957, and "Catalytic Processes and Proven Catalysts", edited by C. L. Thomas, Academic Press (1970), point out that hydrotreating reduces aromaticity.

As used herein, "hydrotreating" is any process which contacts a decant oil with hydrogen in the presence of a catalyst in accordance with the art.

Contrary to the teachings in the art, it has now been found that decant oil which has been hydrotreated according to the invention can be processed to produce mesophase pitch having improved properties as compared to mesophase pitch produced from decant oil which has not been hydrotreated.

Furthermore, the improved mesophase pitch can be processed according to known methods into carbon fibers which also possess improved properties.

A general explanation of these surprising results is as follows and it is to be understood that the explanation is not intended to be a limitation but only as a possible guideline in applying the instant invention. The explanation is given with respect to the thermal polymerization process for converting a precursor pitch feedstock to a mesophase pitch.

Typically, a precursor pitch has a relatively broad molecular weight distribution. The pitch contains both less reactive and highly reactive molecules. Rapid polymerization of the higly reactive molecules is undesirable because it leads to very high molecular weight components in the mesophase pitch produced. These high molecular weight components cause the viscosity of the mesophase pitch to be relatively high and thereby reduce the relative mesophase domain size. This phenomena is discussed in U.S. Pat. No. 3,976,729 I. C. Lewis et al.

Hydrogenation of a decant oil according to the invention reduces the reaction rate of the highly reactive molecules and makes it possible for these molecules to undergo desirable structural rearrangements prior to and during the polymerization reaction. This effects a relatively low viscosity for the mesophase pitch as well as relatively large anisotropic domain sizes.

A precursor pitch feedstock produced according to the invention can also be converted to a mesophase pitch by solvent extraction as described in the article "Mesophase Transformation in a Solvent-Extracted Pitch" by J. E. Zimmer, Fifteenth Biennial Conference on Carbon, June 1981, pp. 146, 147 and the references cited therein. Surprisingly, the mesophase pitch produced possesses excellent properties as to domain size and softening point.

The hydrogenated decant oil produces a lower yield of mesophase pitch as compared to untreated decant oil, but the surprising improvement in the quality of the mesophase pitch compensates for the loss in yield as well as the increased cost for the hydrotreating step.

In its broadest embodiment, the invention relates to a method for producing a feedstock for a mesophase pitch, comprising the steps of hydrotreating a decant oil until there is from about 2 to about 3 hydrogen atoms per average molecule of the decant oil, and distilling the hydrotreated decant oil to form a pitch.

The invention also relates to mesophase pitch fibers and carbon fibers formed from the mesophase pitch of the invention.

Another embodiment of the invention relates to the improvement of subjecting the hydrotreated decant oil to a thermal-pressure treatment to produce a tar residue, and distilling the tar residue to form a pitch.

The thermal-pressure treatment substantially increases the overall yield of the feedstock with respect to the decant oil as compared to the instant process without the thermal-treatment.

Generally, the thermal-pressure treatment is in accordance with the co-pending application Ser. No. 087,186, filed Oct. 22, 1979 and assigned to the instant assignee. The application Ser. No. 087,186 has been allowed and its disclosure is incorporated herein by reference. A brief description of the application is as follows.

The severity of the heating under pressure can be evaluated by the term "soaking volume factor" which is a technical term widely used in the petroleum industry for such a purpose. A soaking volume factor of 1.0 is equivalent to 4.28 hours of heating at a temperature of about 427° C. under a pressure of about 750 psig. The effect of temperature on polymerization or cracking rate of hydrocarbons is known in the art. By way of example, the cracking rate at 450° C. is 3.68 times the cracking rate at 427° C. Most of the examples given herein were carried out at a temperature near 450° C. so that the thermal treatment severity was calculated on an equivalent basis for that temperature.

For a batch thermal-pressure treatment, the preferred temperatures, pressure, and soaking volume factor range depend upon the precursor materials. For decant oils, the temperature range is from about 400° C. to about 475° C., the pressure range is from about 200 psig to about 1500 psig, and the soaking volume factor range is from about 0.4 to about 8.6. The soaking volume factor is equivalent to from about 0.5 to about 10 hours at about 450° C.

The batch thermal-pressure treatment is discontinued when the Conradson carbon content is at least about 20% and preferably greater than about 30% but not greater than about 65%. The mesophase content is less than about 60% by weight and if infusible solids are present, a high temperature filtration is preferably carried out. For the filtration, an elevated temperature to liquify the product is used so that the infusible solids can be separated be the filtration. Preferably, stirring is used during the thermal-pressure treatment in order to maintain a homogeneous distribution.

The instant invention is more economical if a continuous thermal-pressure treatment is carried out instead of the batch treatment. For the continuous thermal-pressure treatment, the temperature range is from about 420° C. to about 550° C., the pressure range is from about 200 psig to about 1500 psig, and the soaking volume factor is from about 0.4 to about 2.6. The soaking volume factor corresponds to from about 0.5 to about 3 hours at a temperature of about 450° C.

The continuous thermal-pressure treatment is terminated when the Conradson carbon content of the material is at least about 5% and preferably greater than about 10% but less than about 65%. The mesophase content is less than about 60% by weight. If infusible solids are present, a high temperature filtration is preferable.

The invention accordingly comprises the several steps and the relationship of one or more of such steps with respect to each of the others, all as exemplified in the following detailed disclosure, and the scope of the application of which will be indicated in the claims.

For a fuller understanding of the nature and objects of the invention, reference should be had to the following detailed description, taken in connection with the accompanying drawings, in which.

Illustrative, non-limiting examples of the practice of the invention are set out below. Numerous other examples can readily be evolved in the light of the guiding principles and teachings contained herein. The examples given herein are intended merely to illustrate the invention and not in any sense to limit the manner in which the invention can be practiced. The parts and percentages recited herein unless specifically provided otherwise refer to parts by weight and percentages by weight.

Figure 1:
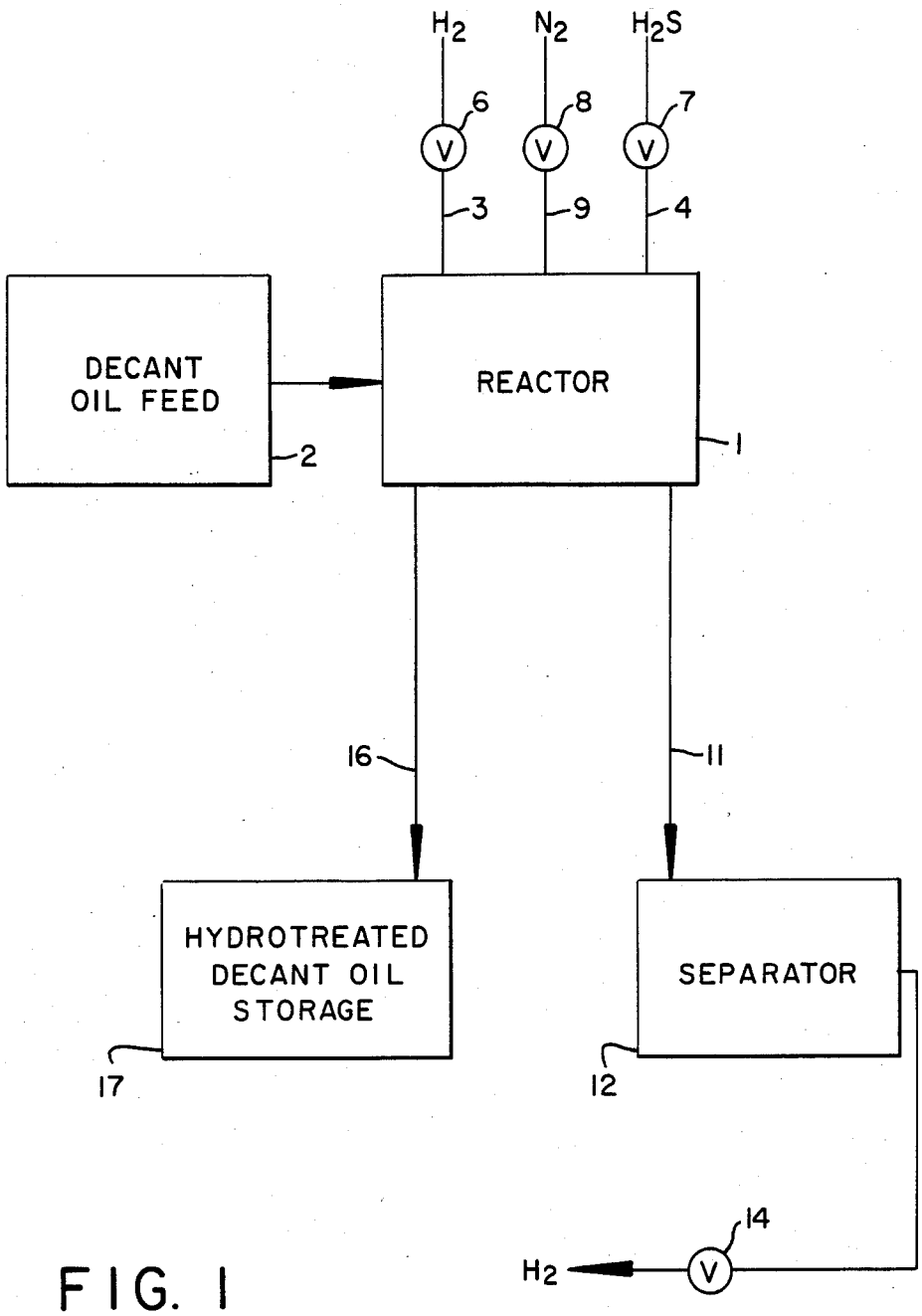
FIG. 1 shows a simplified flow diagram for hydrotreating decant oil.

FIG. 1 hydrotreats decant oil as follows.

A reactor 1 comprises a stainless steel tube having an inside diameter of 32 mm and is heated with a resistance furnace (not shown). The reactor 1 operates in a tricklebed mode with the decant oil from a decant oil feed 2 entering from the top.

The hydrotreating catalyst in the reactor is of the type commonly used for hydrodesulfurizing petroleum feedstocks. Catalyst pellets amounting to 100 ml are mixed with 200 ml of quartz chips (12/16 mesh) and loaded into the stainless steel tube. The resulting catalyst bed is 370 mm long.

A fresh catalyst bed is activated with hydrogen and hydrogen sulfide which are supplied through lines 3 and 4 and controlled by valves 6 and 7.

The nitrogen supplied by line 8 and controlled by valve 9 is used to purge the catalyst of any dissolved hydrogen sulfide.

Gases from the reactor 1 are removed over line 11 to a separator 12 and recovered hydrogen is removed over line 13 through valve 14. Hydrotreated decant oil is removed from the reactor 1 over line 16 to storage 17.

Figure 2:
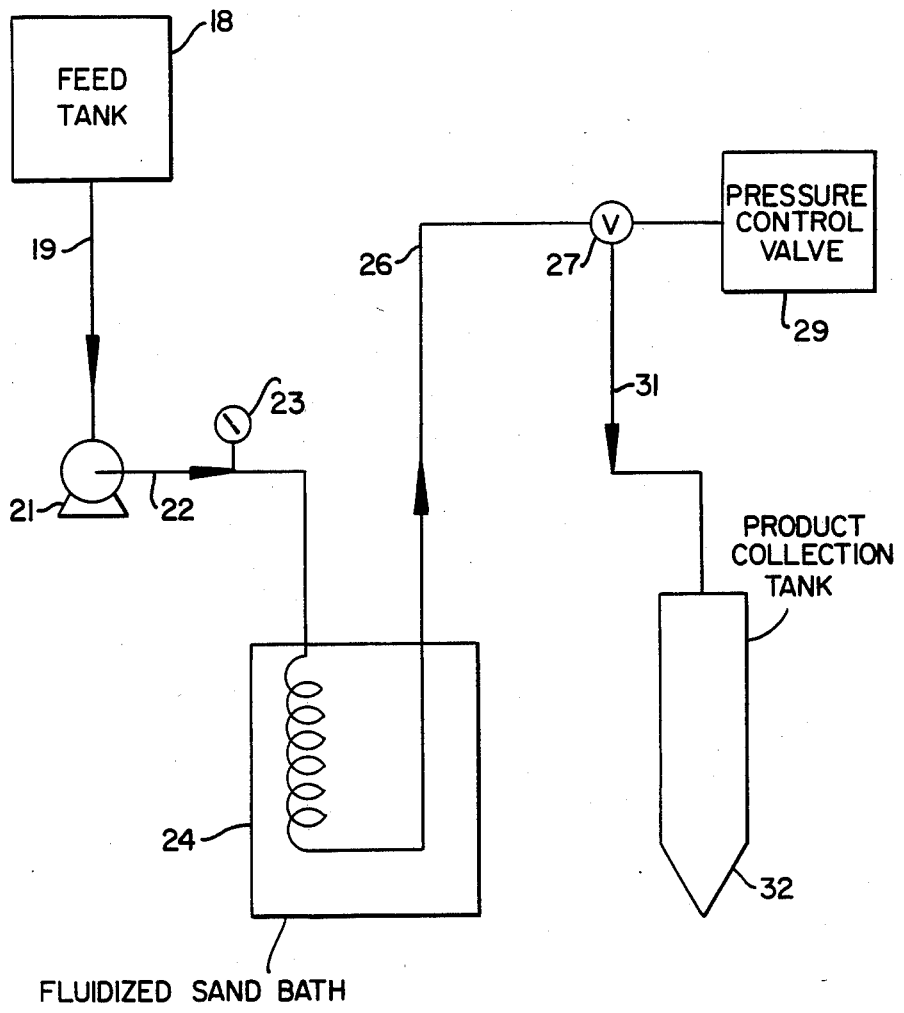
FIG. 2 is a simplified flow diagram for carrying out the continuous thermal-pressure treatment of a hydrotreated decant oil.

The continuous thermal-pressure treatment as shown in FIG. 2 is as follows.

The hydrotreated decant oil is placed in feed tank 18. The feed tank 18 can include heaters if desired for heating the decant oil to lower its viscosity and thereby improve its flow. The feed tank 18 is connected by line 19 to a pump 21 which pumps the decant oil through line 22 and is monitored by a pressure guage 23.

The decant oil moves through a furnace coil in a fluidized sand bath 24. If a longer treatment is desired, several fluidized sand baths can be used in tandem.

The treated decant oil moves through line 26 to valve 27 which is controlled by a pressure control 29 and is collected through line 31 in a product collection tank 32 for subsequent steps of the invention.

EXAMPLE 1

A decant oil was subjected to a hydrotreatment to the extent that an analysis showed that there were about 3 atoms of hydrogen for each average molecule of the decant oil. The hydrotreatment was carried out using a conventional process.

The hydrotreated decant oil was converted to a pitch by distilling under a vacuum of about 2 mm Hg to a final pot temperature of about 260° C.

In order to evaluate the quality of the precursor pitch as a feedstock for mesophase pitch, a portion of the precursor pitch was converted to mesophase pitch by subjecting it to a heat treatment at about 400° C. for about 24 hours. The domain size of the mesophase pitch produced from the heat treatment was measured and found to be about 500 microns. The mesophase pitch produced the same way from untreated decant oil had a domain size which is typically about 250 microns. The larger domain size for the mesophase pitch produced according to the invention is indicative of a better quality mesophase pitch which can be expected to be well suited for commercial spinning.

Furthermore, the relatively large domain size indicates that the mesophase pitch produced according to the invention is highly deformable and the molecules can be expected to align relatively easier when a fiber is spun. This will result in a favorably low orientation parameter and excellent mechanical properties for the carbon fiber.

The precursor pitch obtained amounted to about a 21% by weight yield with respect to the decant oil. The precursor pitch was converted to mesophase pitch by subjecting it to a conventional heat treatment at about 390° C. for about 29 hours while sparging with argon at the rate of about 5 scfh per pound of pitch and with agitation throughout the reaction.

The resulting mesophase pitch contained about 100% mesophase by weight and amounted to a 14% yield with respect to the precursor pitch. The Mettler softening point of the mesophase pitch was about 289° C. This softening point is surprisingly low for a thermally produced mesophase having a 100% mesophase content. Moreover, this mesophase pitch can be spun at a temperature from about 30° C. to about 40° C. lower than the conventional 100% mesophase pitch.

The overall yield of the mesophase pitch with respect to the decant oil was about 3% on a weight basis.

EXAMPLE 2

The hydrogreated decant oil of Example 1 was subjected to a batch thermal-pressure treatment in a stirred autoclave under nitrogen at a pressure from about 400 to about 500 psig and at a temperature of about 430° C. for about 4 hours. A tar residue amounting to about a 90% by weight yield was obtained and thereafter distilled to produce a precursor pitch amounting to a yield of about 37% by weight with respect to the hydrotreated decant oil.

The precursor pitch was then converted to a mesophase pitch by heat treating it at about 390° C. for about 30 hours. The mesophase pitch obtained contained about 100% mesophase and had a Mettler softening point of about 317° C. The mesophase pitch yield was about 34% by weight with respect to the tar residue and the overall yield of the mesophase pitch with respect to the hydrotreated decant oil was about 11.3% by weight.

This overall yield was substantially higher than the overall yield obtained for Example 1 and shows the value of subjecting the hydrotreated decant oil to a thermal-pressure treatment.

The mesophase pitch obtained was spun into monofilaments which are thermoset and thereafter carbonized to a temperature of about 1700° C. in accordance with conventional practice. The filaments had diameters of about 8 microns. Typically, the filaments exhibited excellent mechanical properties. The average Young's modulus was about $28\times10^6$ psi and the average tensile strength was about 560,000 psi. The ratio of these values shows that the strain to failure was about 2% and this is about twice the value obtained for mesophase pitch derived carbon fibers according to the prior art. A high strain to failure value is considered advantageous for many commercial products.

EXAMPLE 3

A second decant oil was hydrotreated until there were about 2 atoms of hydrogen per average molecule of decant oil.

In order to evaluate the hydrotreated decant oil, a portion was heat treated at a temperature of about 400° C. for 24 hours to produce mesophase pitch. The domain size of the mesophase pitch was about 300 microns.

In contrast, the untreated decant oil produced a mesophase pitch having a domain size of about 200 microns for the same test.

The hydrotreated decant oil was subjected to a batch thermal-pressure treatment in a stirred pressure autoclave at a pressure of about 330 psig and a temperature of about 440° C. for about 4 hours. The tar residue obtained amounted to about a 79% by weight yield with respect to the decant oil. The tar residue was vacuum distilled at 2 mm pressure to a pot temperature of about 262° C. The feedstock obtained amounted to a 58% by weight yield with respect to the tar residue and thereafter was converted to a mesophase pitch by conventional thermal polymerization using a reactor at a temperature of about 390° C. for about 24 hours while sparging with argon at a rate of about 5 scfh per pound of pitch. The mesophase pitch produced amounted to about 58% by weight yield with respect to the feedstock and had a softening point of about 332° C. The mesophase content was about 100% by weight.

The mesophase pitch was spun into monofilaments and the monofilaments were thermoset by heating them in air at a temperature of about 375° C. The thermoset filaments were carbonized to a temperature of about 1700° C. in accordance with the art. The carbon fibers had diameters of about 18 microns.

The carbon fibers had an average Young's modulus of about $22\times10^6$ psi and an average tensile strength of about $200\times10^3$ psi. For comparison, mesophase pitch derived carbon fibers made from untreated decant oil had an average Young's modulus of about $22\times10^6$ psi and an average tensile strength of about $165\times10^3$ psi.

EXAMPLE 4

Another decant oil was hydrotreated to the extent that there were about 2 hydrogen atoms per average molecule of the decant oil. A portion of the hydrotreated decant oil was converted to mesophase pitch as in the foregoing examples and the domain size of the mesophase pitch was measured to be about 260 microns.

In contrast, mesophase pitch produced from the decant oil without hydrotreating had a measured domain size of about 179 microns.

EXAMPLE 5

The decant oil of the Example 1 was hydrotreated until there were about 3 hydrogen atoms per average molecule of the decant oil. The hydrotreated decant oil was subjected to a continuous thermal-pressure treatment at a pressure of about 1750 psig at a temperature of about 525° C. for about 9 minutes. A tar residue was obtained with a yield of about 97% by weight with respect to the decant oil. The tar residue was distilled to produce a pitch feedstock having a softening point of about 104° C. and constituting a yield of about 27% by weight with respect to the tar residue. The feedstock was heat treated in a stirred reactor at a temperature of about 400° C. for a period of about 18.5 hours while being sparged with steam at the rate of about 1 scfh per pound of pitch. The mesophase pitch obtained amounted to a yield of about 52% by weight with respect to the feedstock and had a softening point of about 318° C. The mesophase content was about 95% by weight.

The mesophase pitch was spun into multifilaments and the multifilaments were thermoset by heating in air to about 375° C. and then carbonized in an inert atmosphere to a temperature of about 2500° C. in accordance with the art. The average properties of the carbon fibers were a Young's modulus of about $100\times10^6$ psi and a tensile strength of about $390\times10^3$ psi.

For comparison, decant oil which had not been hydrotreated was processed to make mesophase pitch. The decant oil was converted to a tar residue by subjecting the decant oil to a batch thermal-pressure treatment of a pressure of about 1000 psig at a temperature of about 470° C. for about 8 minutes. The tar residue obtained amounted to a 98.5% by weight yield with respect to the decant oil and was distilled to form a precursor pitch having a softening point of about 116° C. and amounting to a yield of about 34% by weight with respect to the tar residue. The pitch was converted to mesophase pitch by heating it at a temperature of about 400° C. for about 16.5 hours. This mesophase pitch amounted to a yield of about 56% by weight with respect to the precursor pitch and had a softening point of about 318° C. The mesophase content was about 90% by weight.

This mesophase pitch was processed into carbon filaments as in the case of the mesophase pitch derived from the hydrotreated decant oil. The carbon fibers obtained had an average Young's modulus of about $63\times10^6$ psi and a tensile strength of about $280\times10^3$ psi.

The carbon fibers which has been produced from feedstock derived from hydrotreated decant oil showed superior mechanical properties as compared to carbon fibers derived from untreated decant oil.

EXAMPLE 6

The pitch feedstock derived from hydrotreated decant oil of the Example 5 was solvent extracted to obtain mesophase pitch. The solvent extraction was carried out by stirring solid feedstock with toluene at room temperature for one hour. The feedstock to toluene ratio was 1 g.:10 ml. The insoluble portion obtained in 8.3% by weight yield was mesophase pitch containing about 85% by weight mesophase. This mesophase pitch has a Mettler softening point of 272° C. and the anisotropic domain size was about 500 microns.

SUMMARY OF EXAMPLES

Table 1 is a summary of data of the Examples 1 to 6. The hydrotreated decant oil is desulfurized as indicated by the data.

The aromatic hydrogen content was measured by the conventinal nuclear magnetic resonance (NMR).

TABLE 1

| | Empirical Formula | | % Aromatic Hydrogen | | % Composition | |
|---|---|---|---|---|---|---|
| Ex. | Before Hydro. | After Hydro. | Before Hydro. | After Hydro. | Before Hydro. | After Hydro: |
| 1. | $C_{22.5}H_{22.5}S_{.15}$ | $C_{22.5}H_{25.5}S_{.04}$ | 36 | 27 | S:1.6<br>C:89.8<br>H:7.6 | S:0.45<br>C:91<br>H:8.5 |
| 2. | same as Ex. 1 | | | | | |
| 3. | $C_{22}H_{22}S_{.1}$ | $C_{22}H_{24}S_{.1}$ | 35 | 32 | S:1.12<br>C:89.5<br>H:7.67 | S:0.76<br>C:90.6<br>H:8.17 |
| 4. | $C_{25}H_{27}S_{.2}$ | $C_{25}H_{29}S_{.1}$ | 28 | 27 | S:2.35<br>C:89<br>H:8.2 | S:0.79<br>C:89<br>H:8.7 |
| 5. | same as Ex. 1 | | | | | |
| 6. | same as Ex. 1 | | | | | |

It is to be understood that we do not wish to be limited to the exact details shown and described because obvious modifications will occur to a person skilled in the art.

Having thus described the invention, what we claim as new and desire to be secured by Letters Patent is as follows:

1. A method for producing a feedstock for a mesophase pitch having a mesophase content of at least 70% by weight, comprising the steps of:

hydrotreating a decant oil until there is an increase from about 2 to about 3 hydrogen atoms per average molecule of the decant oil; and distilling the hydrotreated decant oil to form a pitch.

2. A method for producing a feedstock for a mesophase pitch having a mesophase content of at least 70% by weight, comprising the steps of:

hydrotreating a decant oil until there is an increase of from about 2 to about 3 hydrogen atoms per average molecule of the decant oil;

subjecting the hydrotreated decant oil to a thermal-pressure treatment to produce a tar residue; and distilling the tar residue to form a pitch.

3. A method of claim 2, wherein the thermal-pressure treatment is a batch thermal-pressure treatment wherein the temperature is from about 400° C. to about 475° C. and a pressure of from about 200 psig to about 1500 psig.

4. A method of claim 2, wherein the thermal-pressure treatment is a continuous thermal-pressure treatment wherein the temperature is from about 420° C. to about 550° C. and the pressure is from about 200 psig to about 1500 psig.

* * * * *